US009119256B2

(12) United States Patent
Petsch

(10) Patent No.: US 9,119,256 B2
(45) Date of Patent: Aug. 25, 2015

(54) LED ACTUATION FOR RUNNING LIGHT FLASHERS

(71) Applicant: ZIZALA LICHTSYSTEME GMBH, Wieselburg (AT)

(72) Inventor: Daniel Petsch, Gaming (AT)

(73) Assignee: ZIZALA LICHTSYSTEME GMBH, Wieselburg (AT)

( * ) Notice: Subject to any disclaimer, the term of this patent is extended or adjusted under 35 U.S.C. 154(b) by 0 days.

(21) Appl. No.: 14/350,742

(22) PCT Filed: Feb. 18, 2013

(86) PCT No.: PCT/AT2013/050041

§ 371 (c)(1),
(2) Date: Apr. 9, 2014

(87) PCT Pub. No.: WO2013/123542

PCT Pub. Date: Aug. 29, 2013

(65) Prior Publication Data

US 2014/0246980 A1 Sep. 4, 2014

(30) Foreign Application Priority Data

Feb. 24, 2012 (AT) ..... A 50041/2012

(51) Int. Cl.
*H05B 33/08* (2006.01)

(52) U.S. Cl.
CPC ..... *H05B 33/083* (2013.01); *H05B 33/089* (2013.01)

(58) Field of Classification Search
None
See application file for complete search history.

(56) References Cited

U.S. PATENT DOCUMENTS 4,210,830 A * 7/1980 Fukahori ..... 327/87
5,661,376 A * 8/1997 George ..... 315/368.21

* cited by examiner

*Primary Examiner* — Crystal L Hammond
(74) *Attorney, Agent, or Firm* — Sutherland Asbill & Brennan LLP

(57) ABSTRACT

A light-emitting diode chain comprising a plurality of light-emitting diodes (LED1 . . . LED4) connected in series and fed by a current source, in which each light-emitting diode is assigned a control circuit (5), which has a series connection, connected in parallel with the light-emitting diode, between a reference voltage sink (D1) of the voltage ($U_{ref}$) and a controlled switch (Q) and is designed to compare the control voltage ($U_{st}$) at a control line (4) common to all control circuits, measured against is base point of the LED series circuit, with the voltage at the connection between the switch and the subsequent LED in the chain or the base point, and to close or to open the switch if the control voltage ($U_{st}$) falls below a predefined value or rises above a predefined value respectively.

12 Claims, 8 Drawing Sheets

LED ACTUATION FOR RUNNING LIGHT FLASHERS

Figure 1:
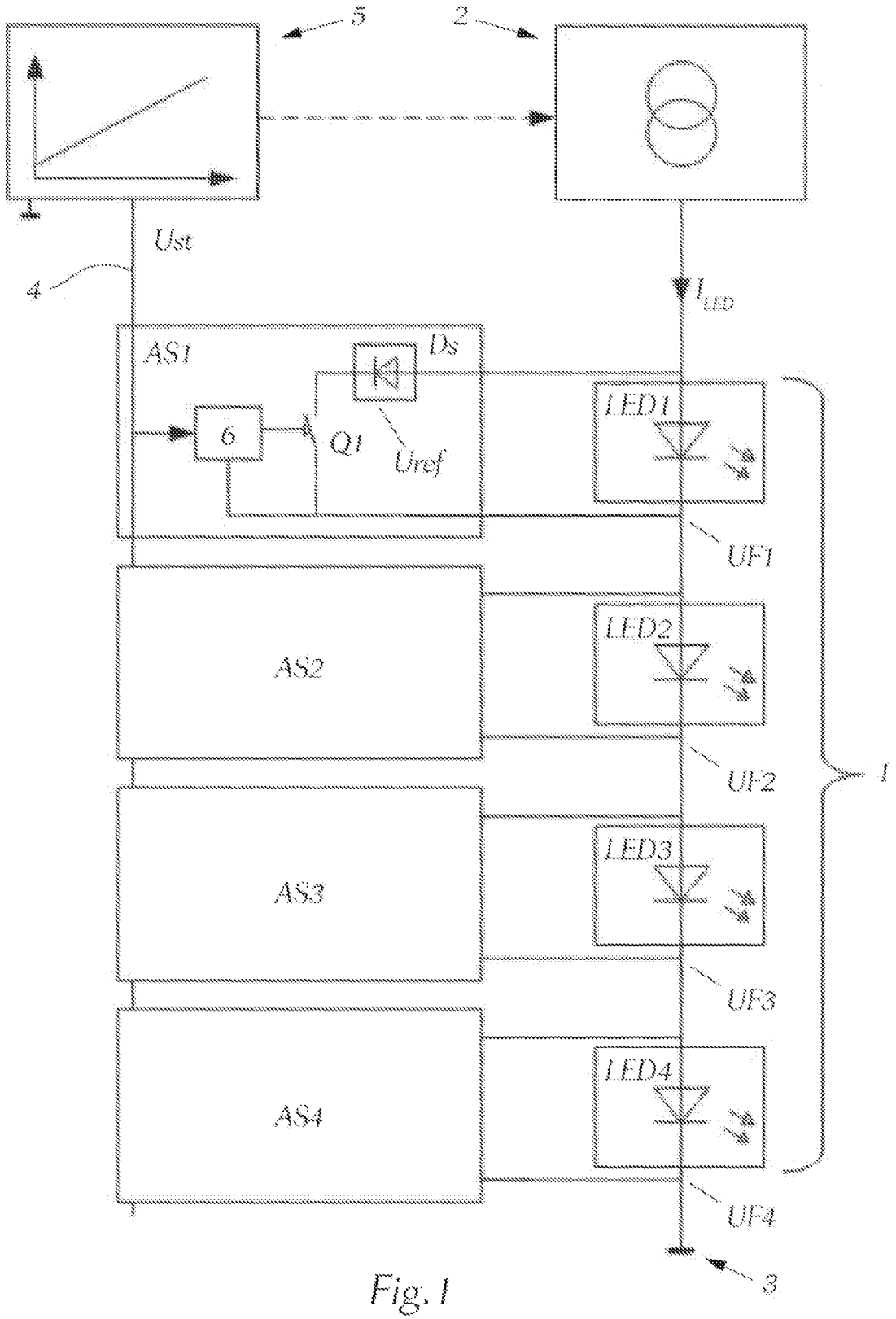

The invention relates to a light-emitting diode chain comprising a plurality of light-emitting diodes connected in series and fed by a current source, wherein each light-emitting diode is assigned a control circuit, which comprises a controlled switch and which is designed to open or to close switches controlled according to a control voltage on a control line common to all control circuits.

Chaser light circuits with LEDs are known, wherein the individual LEDs are each arranged with an electrode on a common feed line and with the other electrodes on supply lines which are fed by a clock generator. This means a high wiring outlay, since individual lines with a number n of LEDs (n+1) are required.

A light-emitting diode chain of the type mentioned in the introduction is known from WO 2010/046806 A1. In this solution according to the prior art, each controlled switch is assigned its own comparator, wherein on the one hand the control voltage on the common control line and on the other hand a partial voltage of a voltage divider of a reference voltage is fed to each comparator. Although a control line is necessary here, the individual comparators not only require additional wiring, but also result in further costs.

A control circuit known from WO 2011/096680 A2 for light-emitting diodes connected in series merely concerns a current supply of the light-emitting diodes arranged in series from an AC network, wherein the LED currents are to be adapted to a half-wave voltage in a current-saving manner, but there is to be no selective switching on or off of individual light-emitting diodes in the series circuit.

An object of the invention is to reduce the wiring complexity for a light-emitting diode chain and to offer a solution which is also suitable in practice with low outlay, and in particular is also suitable for automotive applications.

This object is achieved with a light-emitting diode of the type mentioned in the introduction, in which, in accordance with the invention, each control circuit comprises a series connection, connected in parallel with the light-emitting diode, of a reference voltage sink of the voltage to a controlled switch, and each control circuit is designed to compare the control voltage, measured against a base point of the LED series circuit, with the voltage at the connection between the switch and the subsequent LED in the chain or the base point and to close the switch if the control voltage falls below a predefined value and to open the switch if the control voltage rises above a predefined value.

As a result of the invention, merely three lines for the light-emitting diode chain are necessary, irrespective of the number of LEDs used. The simple and cost-effective control circuit can be installed in the smallest space directly with the light-emitting diode.

A practical variant is characterised n that the control circuit bridges the light-emitting diode with the series connection of the reference voltage sink and the contact-break distance of a controlled semiconductor switch, wherein the sum of reference voltage and forward voltage of the semiconductor switch is smaller than the forward voltage of the light-emitting diode, and a control line common to all light-emitting diodes is provided which lies at the output of a ramp generator generating a voltage ramp and is connected to the control inputs of all semiconductor switches.

In an expedient embodiment the reference voltage sink is formed by at least one reference voltage diode, wherein the reference voltage diode is advantageously a Zener diode.

In accordance with a practical variant the semiconductor switches (Q1) are transistors, in particular MOSFETs.

In order to protect MOSFETs in particular against an undesirably high gate-source voltage, it is expedient if the contact-break distance of the semiconductor switch is bridged by a protective diode, wherein this is advantageously a Zener diode.

In order to ensure that the sink conductor switch switches off reliably, a resistor may be connected in parallel with the protective diode.

Within the sense of protection of the semiconductor switch against excessively high voltages in conjunction with the protective diode, it is advantageous if a protective resistor is present between the control input of the semiconductor switch and the control line.

If an isolation diode is connected between the control line and the control inputs of each of the semiconductor switches, feedback of the control electronics via the control line is avoided.

Although any ramp shapes are possible in principle, it is also expedient within the context of a definable dimensioning if the ramp generator is designed to generate a linearly rising/falling voltage ramp.

Figure 2:
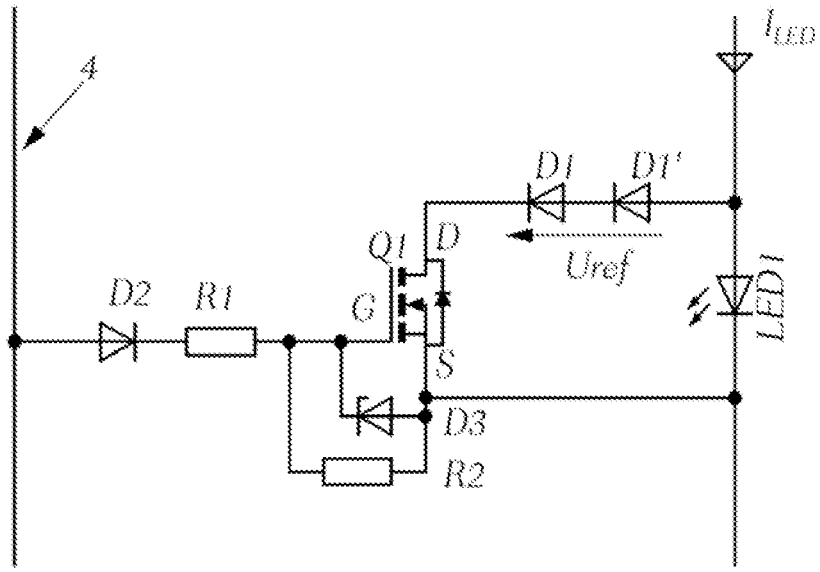
Figure 8:
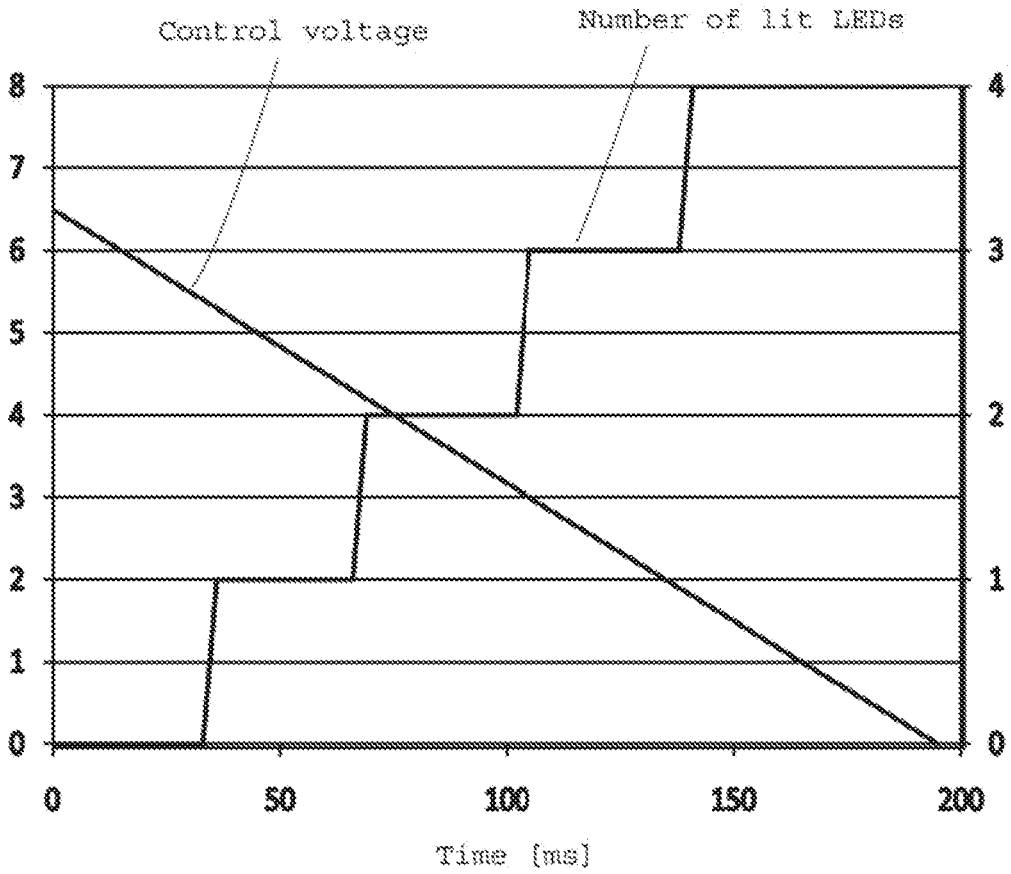
Figure 9:
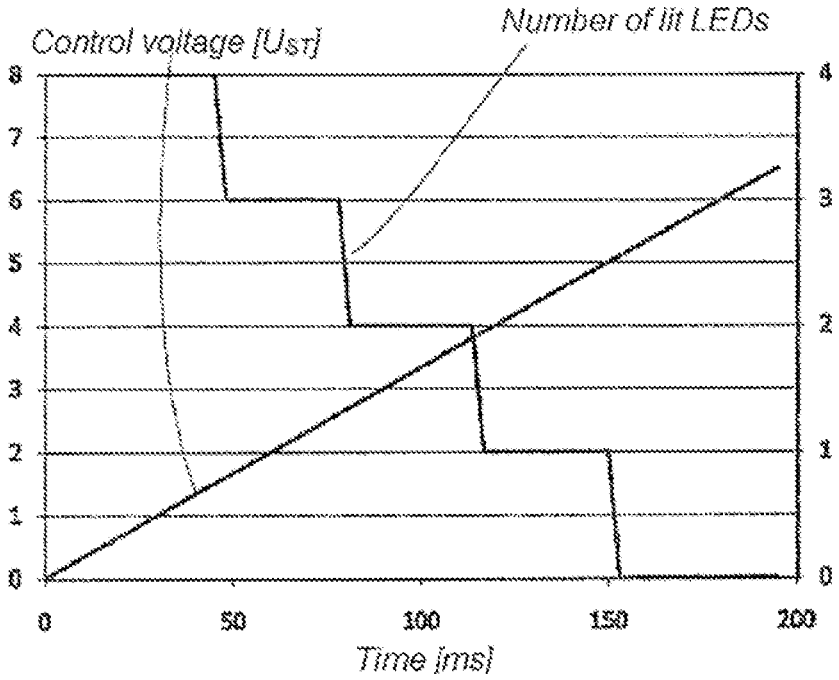
Figure 10:
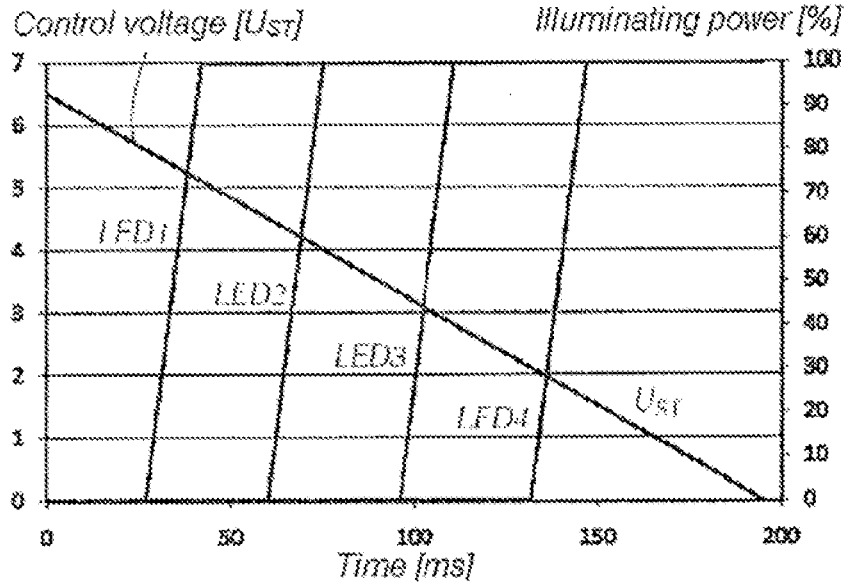

The invention and all further advantages will be explained in greater detail hereinafter on the basis of exemplary embodiments, which are illustrated in the drawing, in which FIG. 1 shows the principle structure of a light-emitting diode chain according to the invention in a block diagram, FIG. 2 shows the circuit diagram of a control circuit of a light-emitting diode of a light-emitting diode chain, FIGS. 3 to 7 show various operating states of a light-emitting diode chain having four light-emitting diodes for example, FIG. 8 shows a graph of the temporal profile of a falling control voltage, and also the number of lit light-emitting diodes of a chain having four light-emitting diodes, FIG. 9 shows a graph similar to FIG. 8, but with rising control voltage, and FIG. 10 shows a graph illustrating the temporal profile of a falling control voltage and also the rise of the brightness of the light-emitting diodes.

FIG. 1 shows the structure of a light-emitting diode chain 1 according to the invention: A current source 2 delivers a current $I_{LED}$ and in this example feeds four light-emitting diodes LED1 to LED4 connected in series against a base point or earth point 3. The light-emitting diodes LED1 . . . LED4 in the light-emitting diode chain do not necessarily have to be individual light-emitting diodes, and series and/or parallel circuits of light-emitting diodes can also be provided instead of a light-emitting diode. A dashed line between the ramp generator 5 and the current source 2 is intended to indicate that an additional control of the current ILED can be implemented where appropriate.

Each light-emitting diode LED1 . . . LED4 is assigned a control circuit AS1 to AS4, which comprises a series circuit of a reference voltage sink $D_s$ of the voltage $U_{ref}$, said series circuit being connected in parallel with the associated light-emitting diode, and a controlled circuit Q.

A control line 4 common to all control circuits AS1 to AS4 lies at the output of a ramp generator 5 and is connected via a comparison circuit 6 (denoted here symbolically) of the control circuits to the control inputs of the controlled switches. Here, each control circuit is designed to compare a control voltage $U_{st}$, which is applied across the control line 4, measured against a base point 3, with the voltage UF1 to UF4 at the connection between the switch Q and the subsequent light-emitting diode LD2 in the chain or the base point 3, and to close the switch Q if the control voltage $U_{st}$ falls below a predefined value and to open the switch Q if the control voltage is above a predefined value.

Since all control circuits are formed identically, an exemplary embodiment of a control circuit tested in practice, which could be assigned to the first light-emitting diode LE1 in the chain, will be described in detail hereinafter with reference to FIG. 2.

The series connection of two diodes connected in the forward direction, which are denoted on the whole by D1 and form a reference voltage sink, with the contact-break distance D-S of a MOSFET Q, of which the source S lies at the cathode of the light-emitting diode LED1 and of which the drain D lies at the cathode of the diode(s) D1, is arranged in parallel with the light-emitting diode LED1. The gate of the transistor Q lies on the control line 4 via the series connection of a protective resistor R1 and an isolation diode D2. The source S and gate G of the MOSFET Q are bridged on the one hand by a Zener diode D3 and on the other hand by a resistor R2.

The isolation diode D2 prevents feedback to the other circuits in the light-emitting diode chain 1, and the protective resistor R1, in combination with the Zener diode D3, prevents dangerously high voltages at the gate-source path of the MOSFET. The resistor R2 ensures that the MOSFET switch can be switched off in spite of the presence of the diode D2. The diode D1 additionally performs the task of compensating for the unavoidable gate-source voltage tolerances of the MOSFET Q1 and of taking into consideration the fact that an FET does not have an exact switching point.

The voltage values specified hereinafter are to serve merely for improved explanation of the function of the invention and are dependent on the components used and the circuit dimensioning. In the shown exemplary embodiment the two diodes forming the reference voltage diode D1 are Schottky diodes for example with a typical forward voltage of 0.6 volts each, and therefore the reference voltage $U_{ref}$ of the reference voltage sink D1 is 1.2 volts at nominal current of the light-emitting diodes. The Zener voltage of the Zener diode D3 is 8.2 volts, and the forward voltage of the diode D2 is 0.6 volts. The MOSFET Q is typically conductive from a gate-source voltage of 2 volts. The forward voltage of the light-emitting diodes is typically 2 volts.

With further reference to FIGS. 3 to 7, the function of a four-stage light-emitting diode chain will now be explained, wherein it is clear to a person skilled in the art that the invention is in no way limited to a specific number of light-emitting diodes and that more or fewer than our stages can be provided with corresponding dimensioning.

Figure 3:
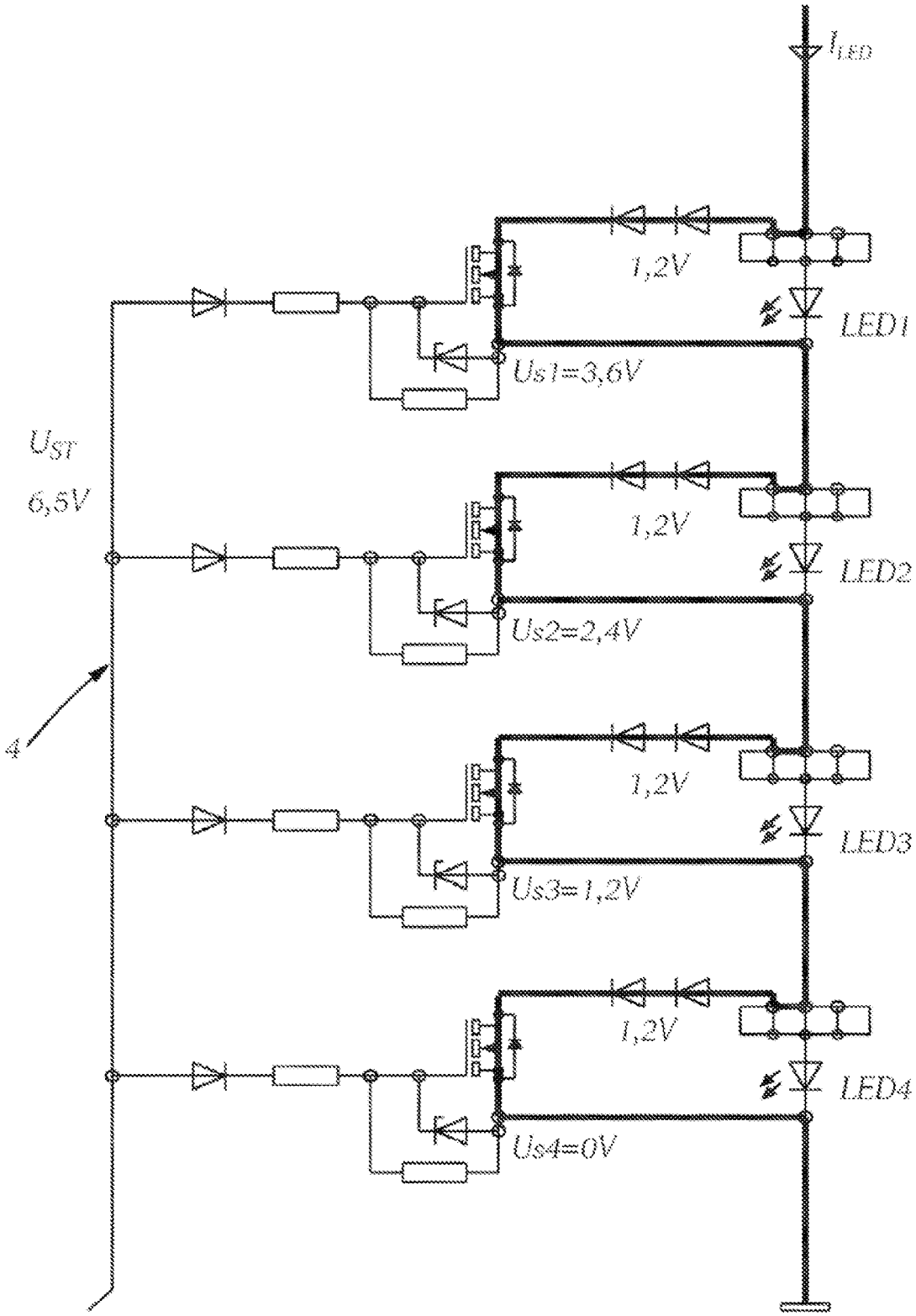

In a first phase according to FIG. 3 the control voltage $U_{st}$ is 6.5 volts. The voltage at the connection between the switch Q and the subsequent LED in the chain or the base point is $U_{s1}$=3.6 volts, $U_{s2}$=2.4 volts, $U_{s3}$=1.2 volts and $U_{s4}$=0 volts. The gate-source voltage of each MOSFET is greater than 2 volts, specifically 2.3 volts, 3.5 volts, 4.7 volts and 5.9 volts for the first to fourth stage, and therefore all MOSFETs Q closed and their drain-source voltage is approximately 0 volts. A voltage of 1.2 volts is applied across the light-emitting diodes LED1 to LED4, corresponding substantially to the reference voltage $U_{Ref}$. This voltage lies considerably below the forward voltage of the light-emitting diodes of 2 volts, and no light-emitting diodes are lit. In the graph in FIG. 8, this corresponds to the starting point of the falling voltage ramp.

Figure 4:
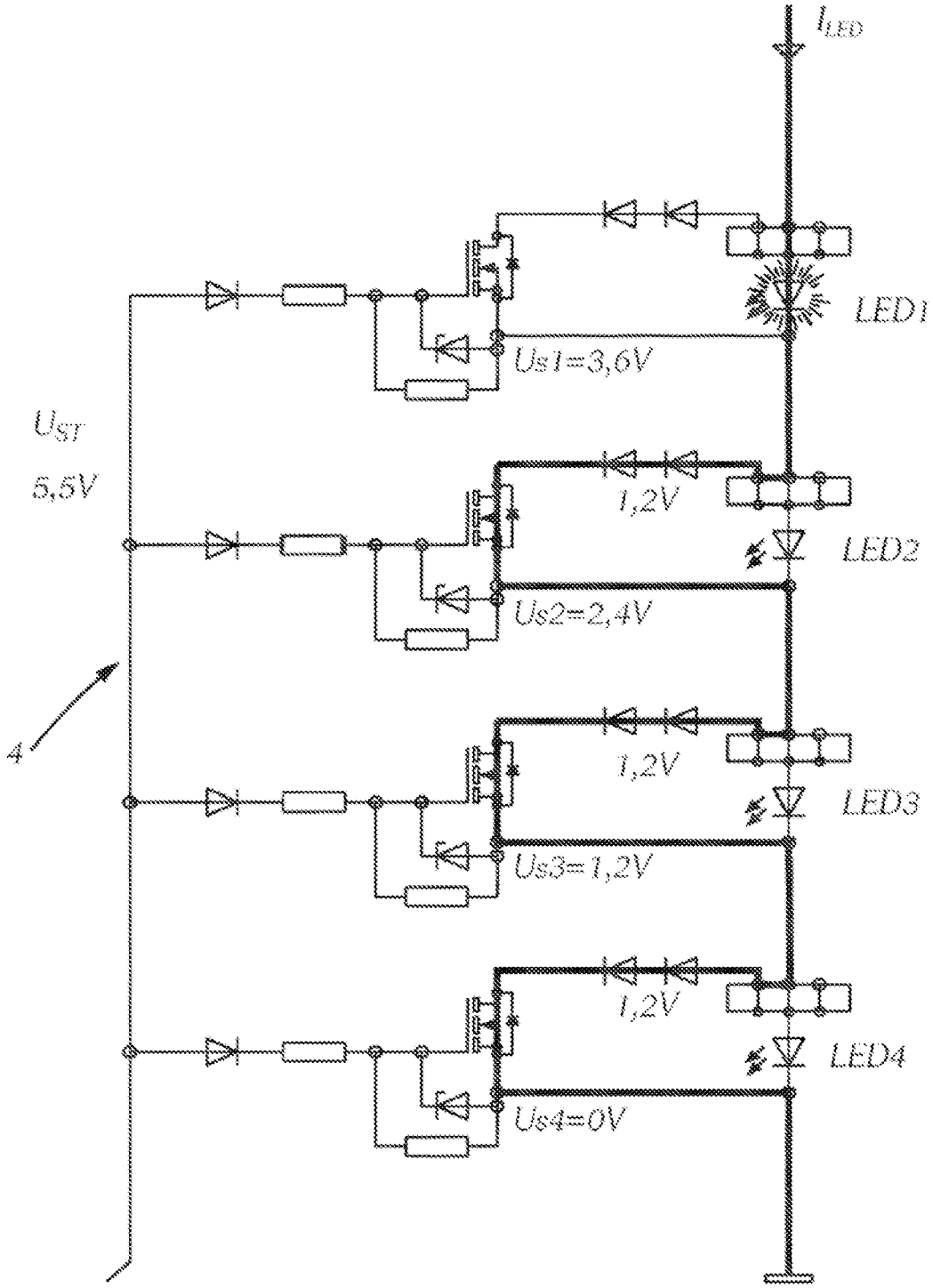

In FIG. 4 the control voltage $U_{st}$ is reduced to 5.5 volts, the gate-source voltage of the MOSFETs of the first stage is only 1.3 volts, the switch Q of the first stage closes, and the first light-emitting diode LED1 is lit.

Figure 5:
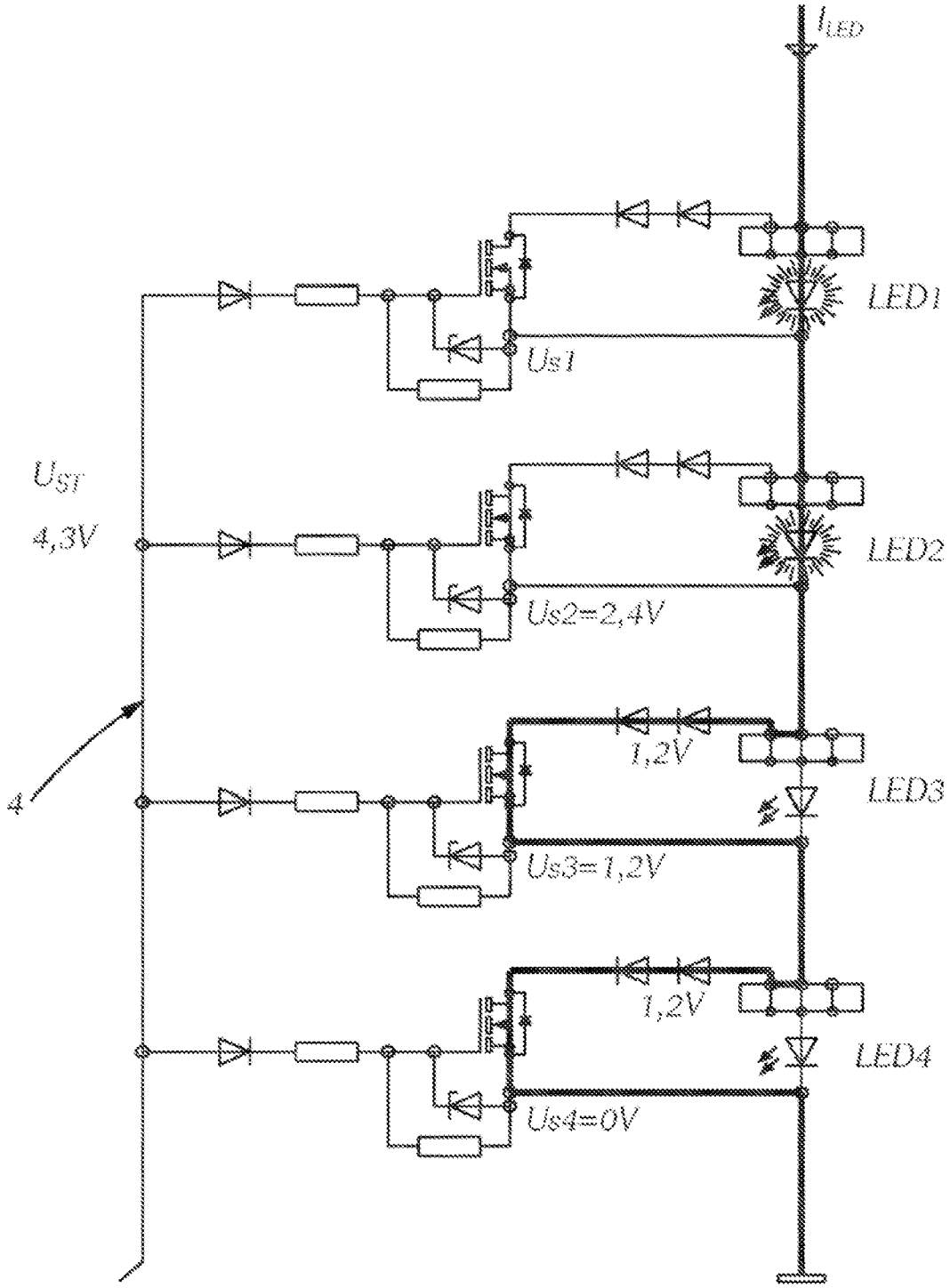

In FIG. 5 the control voltage $U_{st}$ is reduced to 4.3 volts, the gate-source voltage of the MOSFET of the first stage is only 0.1 volts, that of the MOSFET of the second stage is only 1.3 volts, and the switch Q of the second stage therefore also closes and the second light-emitting diode LED2 is lit, as is the first light-emitting diode LED1.

Figure 6:
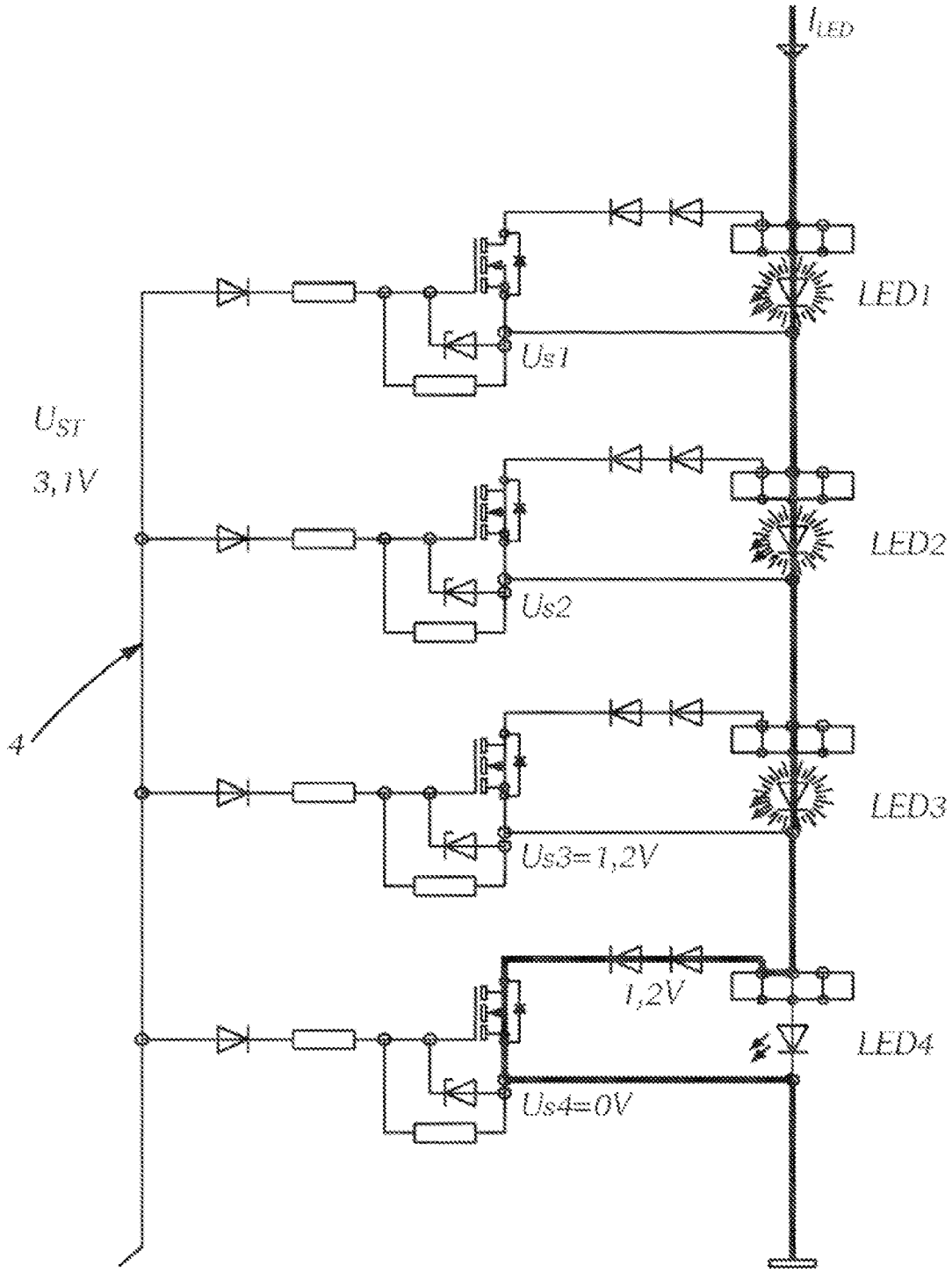

In FIG. 6 the control voltage $U_{st}$ is reduced to 3.1 volts, the gate-source voltage of the MOSFET of the first stage is 0 volts, that of the MOSFET of the second stage is only 0.1 volts, and that of the MOSFET of the third stage is only 1.3 volts, and the switch Q of the third stage therefore also closes now, and the third light-emitting diode LED3 is lit, as are the first and second light-emitting diodes LED 1 and LED 2.

Figure 7:
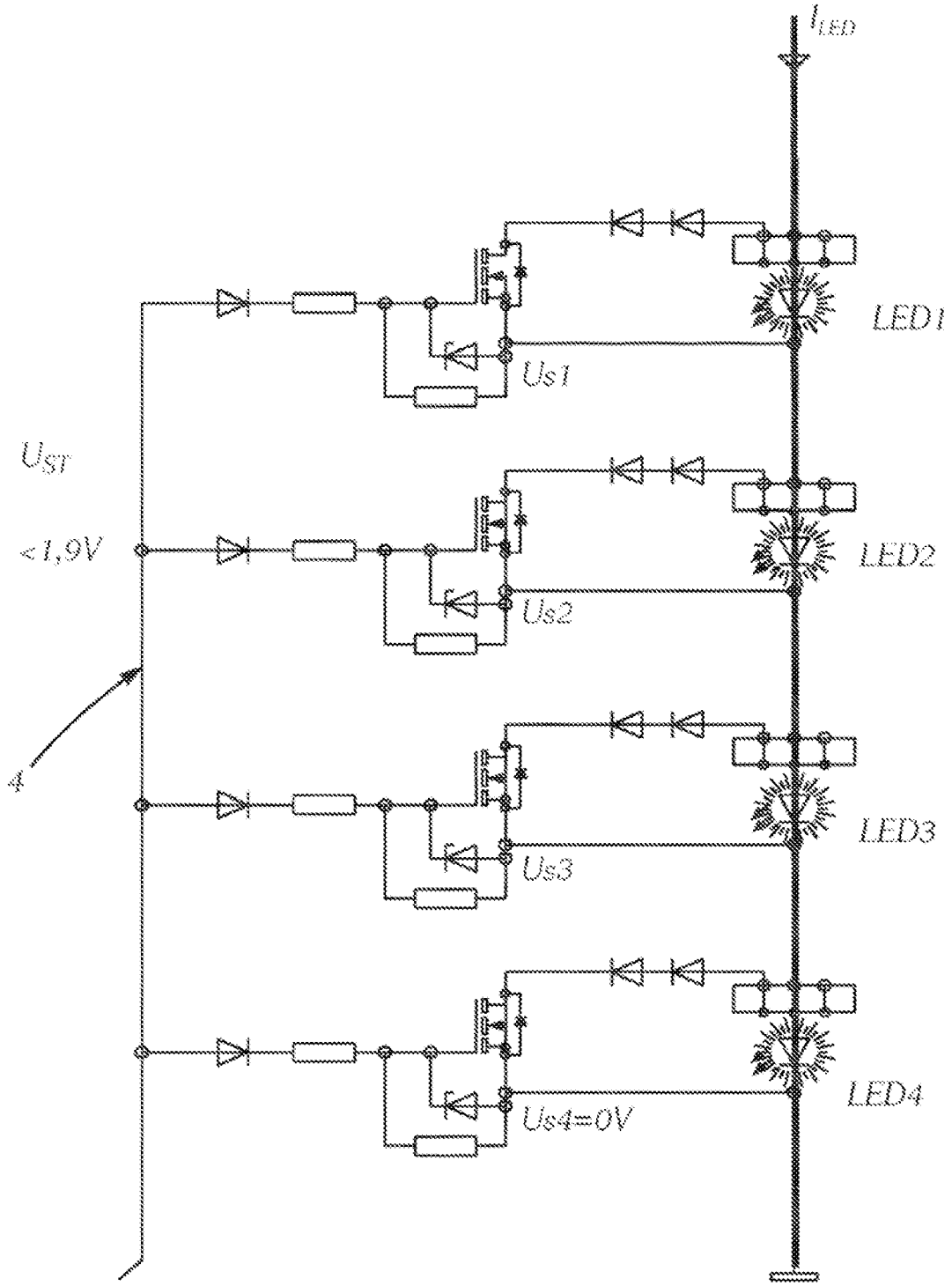

In the phase shown in FIG. 7 all light-emitting diodes LED1 to LED4 are lit, since the gate-source voltages at the MOSFETs of the individual stages (from top to bottom in the drawing) are now 0 volts, 0 volts, 0 volts and 1.3 volts with a control voltage $U_{st}$ of less than 1.9 volts.

No specific voltage values are plotted in the drawing for the source voltages $U_{s1}$ in FIGS. 5, 6 and 7, $U_{s2}$ in FIGS. 6 and 7, and $U_{s3}$ in FIG. 7, since these voltages are determined by the forward voltages of the prior LEDs, which are dependent on type and power.

On the whole, the described operating principle, for example with a linearly falling control voltage $U_{st}$ generated by the ramp generator, means that a running light impression "filling" the light-emitting diode chain is created. To this end reference is made again to FIG. 8, which demonstrates this operating principle for a period of 200 ms. As already mentioned, the profile of the control voltage may also follow other arbitrary functions instead of a linear function.

FIG. 9 shows the profile counter to the profile of FIG. 8 with rising control voltage. During operation, all combinations and modifications are possible, for example a sawtooth-shaped or triangular profile of the control voltage with corresponding light effects of the light-emitting diode chain.

Lastly, FIG. 10 illustrates the dependence of the illuminating power of the four light-emitting diodes used in the example, still with falling control voltage $U_{st}$.

Not illustrated in the detail is the possibility already mentioned above of controlling to a certain extent the current source 2 by the ramp generator 5, and therefore further effects can still be achieved, for example a rising brightness of the light-emitting diodes when "filling" the chain.

The invention claimed is:

1. A light-emitting diode comprising a plurality of light-emitting diodes (LED1 . . . LED4) connected in series and fed by a current source (2), wherein each light-emitting diode is assigned a control circuit (AS1 . . . AS4), which comprises a controlled switch (Q1 . . . Q4) and which is designed to open or to close a switch controlled according to a control voltage ($U_{st}$) on a control line (4) common to all control circuits, wherein each control circuit (AS1 . . . AS4) comprises a series connection, connected in parallel with the light-emitting diode (LED1 . . . LED4), of a reference voltage sink (D1, D1') with a reference voltage ($U_{ref}$) to a controlled switch (Q1) and each control circuit is designed to compare the control voltage ($U_{st}$), measured against a base point of the LED series circuit, with the voltage (UF1 . . . UF4) at the connection between the switch and the subsequent LED in the chain or the base point, and to close the switch if the control voltage ($U_{st}$) falls below a predefined value and to open the switch if the control voltage rises above a predefined value.

2. A light-emitting diode chain according to claim 1, characterized in that the control circuit (AS1 . . . AS4) bridges the light-emitting diode (LED1 . . . LED4) with the series circuit of the reference voltage sink (D1) and the contact-break distance of a controlled semiconductor switch (Q), wherein the sum of reference voltage ($U_{ref}$) and forward voltage ($U_D$) of the semiconductor switch is smaller than the forward voltage of the light-emitting diode (LED1), and the common control line (4) lies at the output of a ramp generator (5) generating a voltage ramp and is connected to the control inputs of all semiconductor switches.

3. The light-emitting diode chain according to claim 1, characterized in that the reference voltage sink (D1, D1') is formed by at least one reference voltage diode.

4. The light-emitting diode chain according to claim 3, characterized in that the reference voltage diode (D1) is a Zener diode.

5. The light-emitting diode chain according to claim 1, characterized in that the semiconductor switches (Q) are transistors.

6. The light-emitting diode chain according to claim 5, characterized in that the semiconductor switches are MOSFETs.

7. The light-emitting diode chain according to claim 1, characterised in that the contact-break distance (G-S) of the semiconductor switch (Q) is bridged by a protective diode (D3).

8. The light-emitting diode chain according to claim 7, characterized in that the protective diode (D3) is a Zener diode.

9. The light-emitting diode chain according to claim 7, characterized in that a resistor (R2) is connected in parallel with the protective diode (D3).

10. The light-emitting diode chain according to claim 1, characterized in that a protective resistor (R1) is arranged between the control input of the semiconductor switch (Q) and the control line.

11. The light-emitting diode chain according to claim 1, characterized in that an isolation diode (D2) is connected between the control line (4) and the control inputs of each semiconductor switch (Q).

12. The light-emitting diode chain according to claim 1, characterized in that the ramp generator (5) is designed to generate a linearly rising/falling voltage ramp.

* * * * *